US008578829B2

(12) United States Patent
Majima et al.

(10) Patent No.: US 8,578,829 B2
(45) Date of Patent: Nov. 12, 2013

(54) PUNCHING UNIT

(75) Inventors: Toshiyuki Majima, Kaga (JP); Kazuo Nishimura, Kaga (JP)

(73) Assignee: Daido Kogyo Co., Ltd., Ishikawa Pref (JP)

( * ) Notice: Subject to any disclaimer, the term of this patent is extended or adjusted under 35 U.S.C. 154(b) by 504 days.

(21) Appl. No.: 12/794,904

(22) Filed: Jun. 7, 2010

(65) Prior Publication Data

US 2011/0023679 A1 Feb. 3, 2011

(30) Foreign Application Priority Data

Aug. 3, 2009 (JP) ..... 2009-181022

(51) Int. Cl.
*B26D 5/08* (2006.01)

(52) U.S. Cl.
USPC ..... 83/618; 83/620; 83/628; 83/684; 83/691; 83/687

(58) Field of Classification Search
USPC ..... 83/620, 628, 691, 694, 687, 518, 624, 83/618, 622, 684; 270/58.07; 234/50, 1, 234/76.8
See application file for complete search history.

(56) References Cited

U.S. PATENT DOCUMENTS

| | | | | |
|---|---|---|---|---|
| 5,778,750 | A * | 7/1998 | Drzewiecki et al. | 83/628 |
| 6,374,715 | B1 * | 4/2002 | Takatsuka | 83/620 |
| 6,622,908 | B2 * | 9/2003 | Fukumoto et al. | 234/98 |
| 6,978,925 | B2 * | 12/2005 | Morson | 234/1 |
| 7,458,505 | B2 * | 12/2008 | Majima et al. | 234/98 |
| 7,823,494 | B2 * | 11/2010 | Baba | 83/628 |
| 2001/0011492 | A1 * | 8/2001 | Fukumoto et al. | 83/549 |
| 2007/0151435 | A1 * | 7/2007 | Kandasamy | 83/588 |

FOREIGN PATENT DOCUMENTS

| | | |
|---|---|---|
| JP | 2001-009791 | 1/2001 |
| WO | WO-2004/035274 | 4/2004 |
| WO | WO-2006/038291 | 4/2006 |

* cited by examiner

*Primary Examiner* — Omar Flores Sanchez
(74) *Attorney, Agent, or Firm* — Jordan and Hamburg LLP

(57) ABSTRACT

There is provided a punching unit capable of punching holes in high-performance by increasing a punching force and by rotating a punch. A guide hole that guides the punch in the vertical direction is formed to have a narrow upper part, a wider lower part and inclined surfaces between them. An actuation pin engages with a cam and the punch moves up and down to punch a hole when a cam member reciprocates. The actuation pin abuts with the inclined surface of the guide hole at the punching position, so that the punch is rotated and a cam inclined angle is reduced by an inclined angle of the guide hole, allowing a large punching force.

4 Claims, 6 Drawing Sheets

| $\alpha$ | $\beta$ | $\alpha-\beta$ | F/Q | RATIO |
|---|---|---|---|---|
| 45 | 0 | 45 | 0.71 | 1 |
| 45 | 5 | 40 | 0.81 | 1.14 |
| 45 | 10 | 35 | 0.91 | 1.28 |
| 45 | 15 | 30 | 1.02 | 1.44 |
| 45 | 20 | 25 | 1.15 | 1.62 |

··· PRIOR ART UNIT OF $\beta$ = 0

PUNCHING UNIT

CROSS REFERENCE TO RELATED APPLICATION

This application claims the foreign priority benefit under Title 35, United States Code, §119 (a)-(d) of Japanese Patent Application No. 2009-181022, filed on Aug. 3, 2009 in the Japan Patent Office, the disclosure of which is herein incorporated by reference in its entirety.

BACKGROUND OF THE INVENTION

1. Field of the Invention

The present invention relates to a punching unit for punching holes through sheets of paper by engaging punches with dies and more specifically to a punching unit that is suitably mounted to and used in an image forming apparatus such as a copier, printer, facsimile or their combined machine to punch filing holes through sheets of paper.

2. Related Art

The present applicant et al. had developed a punching unit for punching holes through sheets of paper by vertically moving punches by reciprocally moving a cam plate that crosses at right angles with the punch moving direction (see Japanese Patent Application Laid-open No. 2001-9791 for example). As shown in FIG. 6, the punching unit 1 has a body frame 2 that supports a cam plate 3 movably in the horizontal direction and a plurality of punches 6 movably in the vertical direction. The punching unit 1 is also provided with a die plate 7 disposed across a paper passing space S from the body frame 2. Dies (holes) 9 are formed through the die plate 7 at positions facing the punches 6 described above. A plurality of cams 10 respectively formed of a grooved hole is formed through the cam plate 3 at predetermined intervals and an actuation pin 11 is planted to each punch 6, respectively. The body frame 2 is provided with guide holes 12 each formed of a linear long hole extending in the vertical direction to guide the actuation pin 11 in connection with the cam 10.

In operation, revolutions of an electric motor 13 is transmitted through a decelerator 15 to a pinion 16 that is engaged with a rack 17 to reciprocate the cam plate 3. As the cam plate 3 reciprocates, the cam 10 and the guide hole 12 guide the pin 11 and move the punches 6 in the vertical direction. Thus, the punch 6 punches holes through sheets of paper located in the space S with the die hole 9. As the cam plate 3 moves in one direction, the punch 6 upheld while being positioned at one-end linear portion 10*a* of the cam 10 is reciprocated in the vertical direction at a V-shaped portion 10*b* of the cam 10 and is then upheld again by moving to another-end linear portion 10*c*. At this time, the pin 11 is guided by the guide hole 12 formed of the linear long hole, so that the punch 6 moves in the vertical direction without turning around its axial line.

In a state in which a capacity of the driving motor 13 is limited to a predetermined capacity and a thrust force Q of the cam plate 3 is limited due to an installation space and others of the punching unit 1, it is effective to reduce an inclined angle (wedge angle) $\alpha$ of the V-shaped portion 10 *b* of the cam 10 in order to obtain a large punching force F of the punch 6.

Because it is necessary to assure a punch moving distance PL to punch holes through sheets of paper, a moving distance (slide stroke) SL of the cam plate 3 must be increased if the inclined angle $\alpha$ of the cam 10 is to be reduced. If the moving distance SL of the cam plate 3 is thus increased, a time required for punching holes is prolonged and the size of the punching unit becomes large, so that it is unable to deal with the high speed operation of the late image forming apparatus such as a printer and to punch through heavy papers. Thus, it is desired to bring out a high-performance punching unit that takes an equivalent installation space with that of the prior art punching unit and does not involve a large modification.

SUMMARY OF THE INVENTION

Accordingly, the present invention aims at solving the abovementioned problems by providing a punching unit that is capable of punching holes through materials to be punched steadily and effectively with a relatively simple structure and without increasing a moving distance of a cam.

According to a first aspect of the invention, there is provided a punching unit for punching holes through materials to be punched by engaging punches with dies, including:

an actuation pin fixed so as to protrude from the side of each punch;

a cam member reciprocated in the direction, e.g., linear or turning horizontal direction, orthogonal to the moving direction, e.g., vertical direction, of the punch;

a cam formed of a grooved hole that is formed through the cam member, engages with the actuation pin and has a V-shaped portion, one linear portion that extends from one end of the V-shaped portion and another linear portion that extends from another end of the V-shaped portion; and a guide hole formed through a fixing member that defines a body frame of the punching unit, the guide hole having a predetermined shape to guide the actuation pin;

wherein the guide hole has one end part having a width fitting with the actuation pin at positions corresponding to the linear portions of the cam and inclined surfaces extending to the both sides of the moving direction of the cam member from the one end part at positions corresponding to the V-shaped portion of the cam; and as the cam member moves, the actuation pin engages with the inclined surface of the V-shaped portion of the cam and the punch moves in the axial direction and at the punching position for punching holes through the material to be punched, the actuation pin is guided by one inclined surface of the guide hole, turns the punch around its axial line and acts so as to reduce an inclined angle of the inclined surface of the cam that moves the punch in the axial direction.

According to a second aspect of the invention, preferably, the guide hole has another end part whose width is wider than the one end part at the position corresponding to the bottom part of the V-shaped portion of the cam and is formed into the shape of a bottle by the one end part, the both inclined surfaces and the other end part.

According to a third aspect of the invention, preferably, the punching unit body frame movably supports the cam member and the punch.

ADVANTAGEOUS EFFECTS OF THE INVENTION

According to the first aspect of the invention, the actuation pin is guided by the inclined surface of the guide hole at the punching position for punching holes through the material to be punched. Then, the actuation pin acts so as to reduce the inclined angle of the inclined surface of the cam that moves the punch in the punching direction, thus allowing a large punching force F to be obtained, and turns the punch itself around its axial line. Accordingly, cutting by the turn of the blade edge of the punch (so-called pulling-cut) is added to a shearing force effected by a punching force (so-called press-cutting), so that the material to be punched such as sheets of paper may be efficiently, steadily and readily punched.

Although the punch becomes slow by the inclined angle of the guide hole at the punching position where the large punching force is required, the delay of the punch described above is recovered in a return stroke for example of at least one stroke of the cam member, so that the reciprocating moving distance (SL) of the cam member is equal with the stroke (PL) of the punch. Thus, it is possible to deal with punching of heavy sheets of paper based on the highly efficient punching described above and also with a throughput of sheets of paper corresponding to high-speed image forming operations.

The present invention may be simply configured just by modifying the shape of the guide hole that guides the actuation pin, may be installed within the equal space with that of the prior art punching unit and the instant punching unit may be mounted on the conventional image forming apparatus while keeping its specification the same or may be replaced with the prior art unit.

According to the second aspect of the invention, the inclined surface of the guide hole corresponds to the punching stating position where the largest punching force is required and the punch is turned around the punching starting position, so that the material to be punched may be punched readily and steadily with the large punching force.

According to the third aspect of the invention, the guide hole is formed through the body frame that supports the cam member and the punch, so that the guide hole having the predetermined shape may be readily, steadily and compactly formed at the front wall of the body frame at low cost.

It is noted that the summary of the invention described above does not necessarily describe all necessary features of the invention. The invention may also be a sub-combination of the features described above.

BRIEF DESCRIPTION OF DRAWINGS

FIGS. 3A through 3C show operations of the punching unit, wherein FIG. 3A illustrates a relationship and operational distances of respective forces of a cam plate and the punch, FIG. 3B shows operations of a prior art unit and FIG. 3C shows operations of the unit of the invention;

FIGS. 4A and 4B show effects of the punching unit of the invention, wherein FIG. 4A is a table and FIG. 4B is a graph thereof;

BEST MODE FOR CARRYING OUT THE INVENTION

Modes of a punching unit for carrying out the invention will be explained below with reference to the drawings. It is noted that the basic structure of the punching unit of the invention is the same with one shown in FIG. 6 except of a guide hole for guiding a pin 11.

Figure 1:
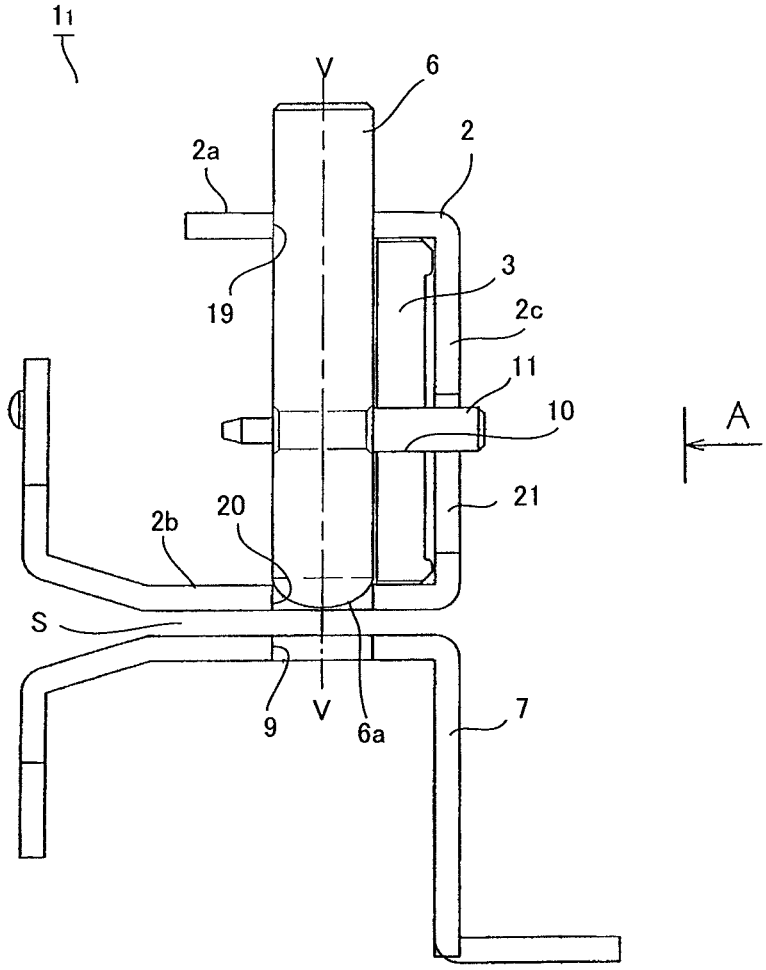
FIG. 1 is a longitudinal section view showing a punching unit of the invention.
Figure 2:
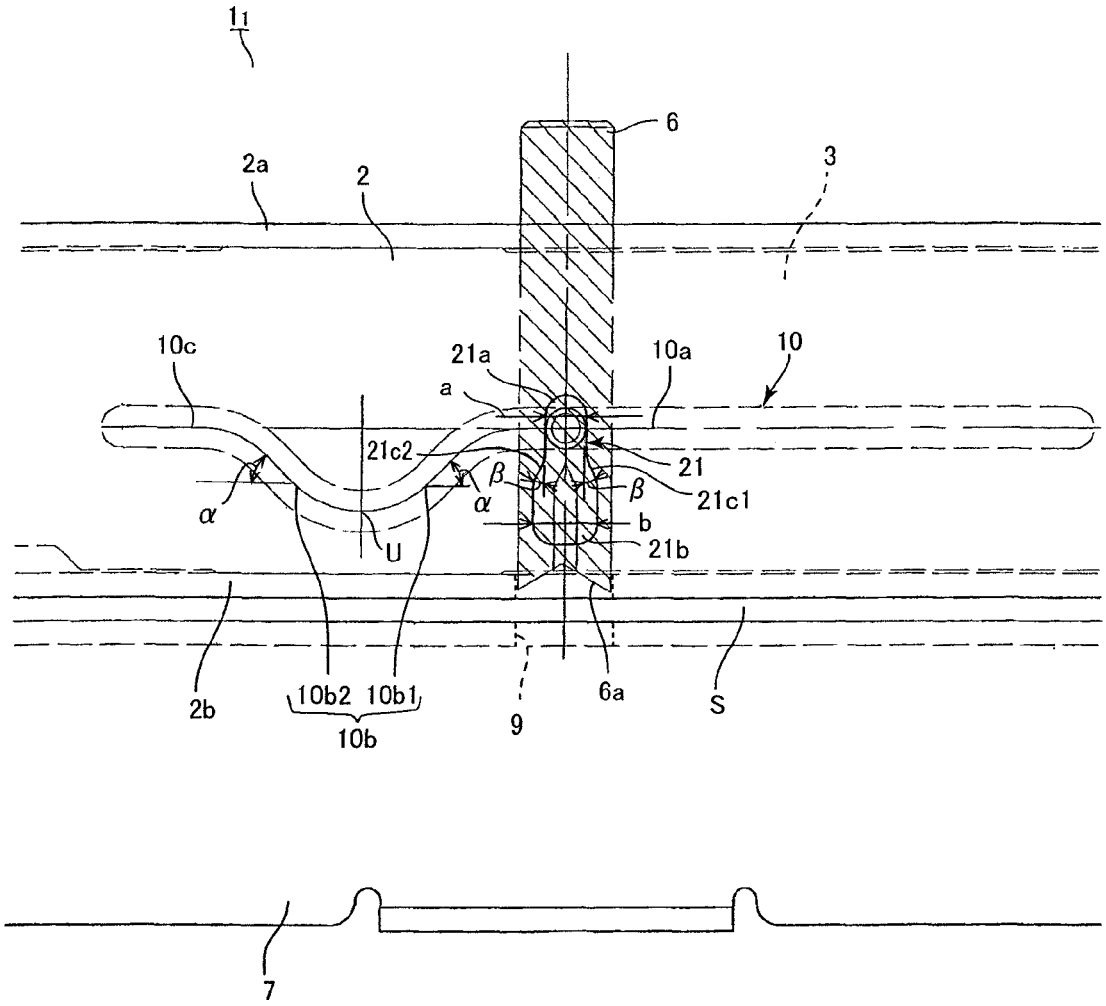
FIG. 2 is a front view seen from an arrow A in FIG. 1.

As shown in FIGS. 1 and 2, the punching unit $\mathbf{1}_1$ has a fixing member that is a body frame 2 that supports a punch 6 movably in the vertical direction through holes 19 and 20 formed through an upper wall 2*a* and a lower wall 2*b* thereof. The body frame 2 also supports a cam plate (cam member) 3 movably in the horizontal direction along a front wall 2*c* thereof between the upper and lower walls 2*a* and 2*b*. A cylindrical actuation pin 11 is fixed to the punch 6 so as to cross at right angles with an axial line V-V of the punch 6 by screwing it into the punch 6 for example. The actuation pin 11 extends while penetrating through a cam 10 formed of a grooved hole through the cam plate 3 and a guide hole 21 formed of a notch through the front wall 2*c* while having a predetermined shape.

It is noted that while the direction in which the punch 6 moves is defined to be the vertical direction (Y direction), the direction in which the cam plate 3 moves to be the horizontal direction (X direction) and the direction of an axial line of the actuation pin 11 to be the front-back direction in the explanation described above, those directions are so defined because sheets of paper are conveyed in the horizontal direction and are punched perpendicularly to that direction in general. However, the directions are not limited to those directions described above and the respective directions mean three directions (X, Y and Z) orthogonal to from each other.

The punching unit $\mathbf{1}_1$ also includes a die plate 7 disposed so as to face to the lower wall 2*b* of the body frame 2. The die plate 7 is provided with a die (hole) 9 at the position facing to the punch 6. The die plate 7 and the lower wall 2*b* of the body frame 2 are positioned and fixed while keeping a paper passing space S between them. An end of the punch 6 is a V-shaped blade edge 6*a* and the die hole 9 has a diameter slightly larger than that of the blade edge 6*a*, so that sheets of paper are sheared and a round hole is opened when the blade edge 6*a* fits and engages with the die hole 9. It is noted that the shape of the blade edge of the punch is not limited to what is symmetrical about the center line as shown in FIG. 1 and may have other shapes such that an apex of a shear angle is offset by a predetermined distance from the punch axial center line or that has two steps of shear angle as disclosed in WO2006/038291 gazette for example.

Figure 6:
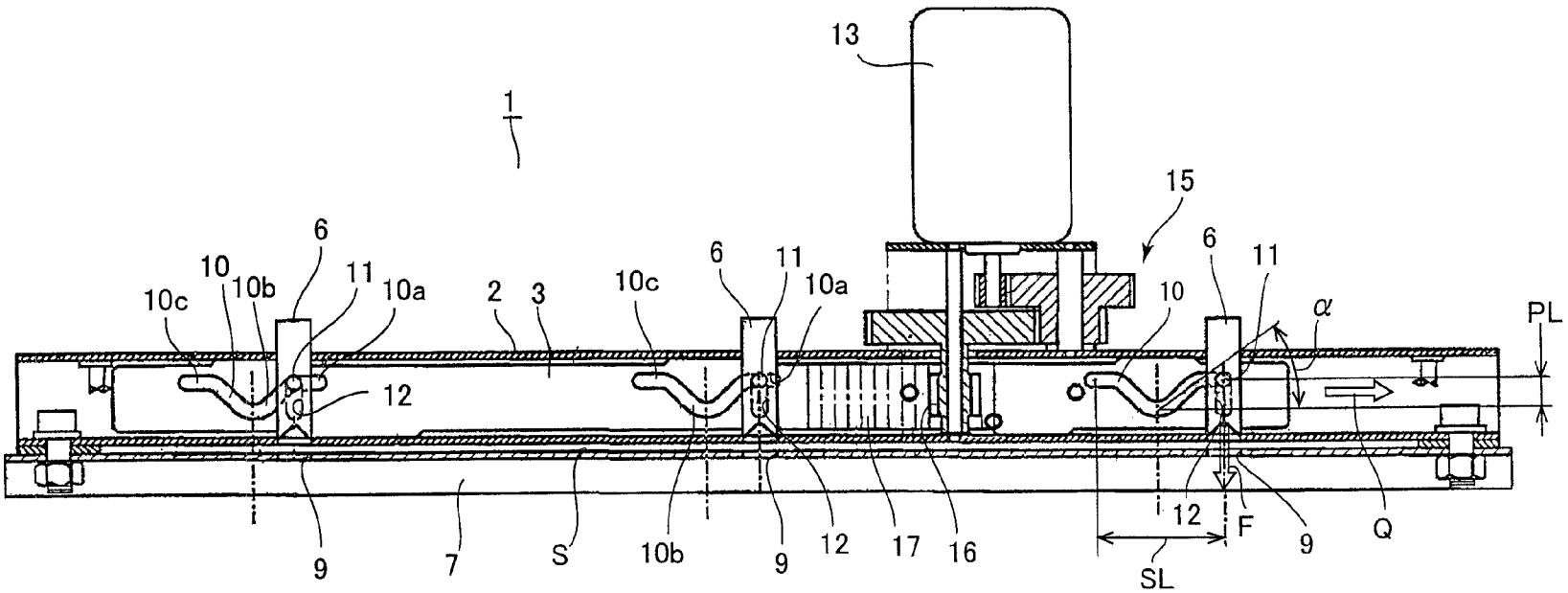
FIG.6 PRIOR ART
FIG. 6 is a front section view showing the entire prior art punching unit.

As shown in FIG. 2 in detail, the cam 10 formed through the cam plate 3 includes a V-shaped portion 10*b* having a left-downward inclined surface 10*b*1 and a right-downward inclined surface 10*b*2, one-end linear portion 10*a* extending in the horizontal direction from an upper end inclining downward to the left and another-end linear portion 10*c* extending in the horizontal direction from an upper end inclining downward to the right. It is noted that while the one-end linear portion 10*a* is formed to be longer than the other-end linear portion 10*c*, it comes from the shapes of the cams for switching a first group including the second, third and other holes with a second group including the fourth and other holes while including a common punch as disclosed in WO2004/035274. That is, it is needless to say that the shape of the cam of the invention is not limited to that and may have another shape such as one in which the cam corresponds to the punch one-to-one as shown in FIG. 6.

As shown in FIG. 2 in detail, the guide hole 21 formed through the front wall 2*c* of the invention has the shape of a bottle in which a lower part 21*b* is wider than an upper part 21*a*. More specifically, the upper part 21*a* of the guide hole has a width a slightly larger than (fitting with) the diameter of the actuation pin 11 and is formed at the position (level) corresponding to the linear portions 10*a* and 10*c* of the cam 10. While the actuation pin 11 moves the punch 6 by being guided straightly in the vertical direction, the pin 11 holds the punch 6 without turning when it is located at the cam linear portion 10*a* or 10*c* described above. The lower part 21*b* of the guide hole has a width b larger than the diameter of the pin 11 corresponding to the level of a bottom part U of the V-shaped portion 10*b* of the cam 10. For instance, the width b of the lower part is formed to be wider than the width a of the upper part by 1.3 to 2.0 times or more preferably 1.5 to 1.6 times so that the pin 11 may be moved by a predetermined distance (b−a) in the horizontal direction.

Then, the parts between the upper and lower parts 21*a* and 21*b* of the guide hole 21 are formed to continue smoothly with inclined surfaces 21*c*1 and 21*c*2 each having a predetermined angle β. The right and left inclined surfaces 21*c*1 and 21*c*2 are formed symmetrically at the same level and correspond to the inclined surfaces 10*b*1 and 10*b*2, having the angle α, of the cam 10 and to the neighborhood including at least a part where the largest punching force is required in punching a hole through the sheets of paper by the punch 6.

Figure 3A:
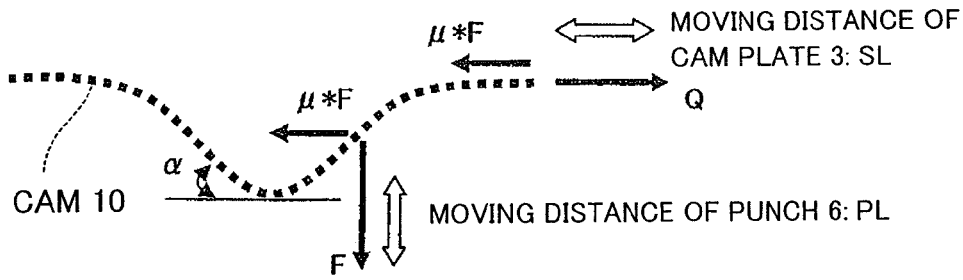
Figure 3B:
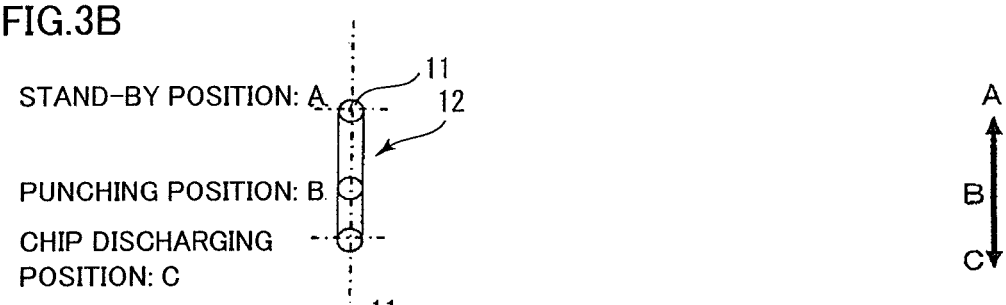

Next, operations of the present embodiment based on the structure described above will be explained with reference to FIG. 3. When the cam plate 3 is moved in one direction of the horizontal direction, e.g., in the right direction as shown in FIG. 3A, a frictional force μ*F is generated, where Q is a thrust force acting on the cam plate 3, F is a punching force changed in the vertical direction by the cam 10 and μ is a frictional coefficient acting on the cam 10 and the actuation pin 11. Here, if the guide hole 12 is a straight long hole as shown in FIG. 3B (see FIG. 6), in one stroke of the cam plate in the right direction, the punch 6 goes through a stand-by position A where the actuation pin 11 is located at the one-end linear portion 10*a*, a punching position B where the actuation pin 11 is located at the left-downward inclined surface 10*b*1 of the V-shaped portion 10*b*, a chip discharging position C where the actuation pin 11 is located at the bottom part U of the V-shaped portion 10*b* and returns to the stand-by position A where the actuation pin 11 is located at the other-end linear portion 10*c* by going through a return stroke (C B) where the actuation pin 11 is located at the right-downward inclined surface 10*b*2. When the cam plate 3 is moved in the left direction from this position, the punch 6 goes through the stand-by position A, the punching position B, the chip discharging position C and the stand-by position A where the actuation pin 11 is located at the one-end linear portion 10*a* by going through the return stroke (C→B) in the same manner.

Beside the frictional force μ*F acting between the cam 10 formed of the grooved hole and the actuation pin 11, the equal frictional force μ*F also acts, as its reaction force, between the cam plate 3 and the body frame 2 in the vertical movement (A-B-C) of the punch 6 described above, so that the frictional force amounts [2*F*μ]. Because the inclined angle (wedge angle) of the inclined surfaces 10*b*1 and 10*b*2 of the cam 10 is α, the thrust force Q acting on the cam plate 3 and the punching force F acting on the punch 6 have the following relationship:

$$Q=F^*(\tan\alpha+2^*\mu) \quad (1)$$

Then, the effect of the inclined angle (wedge angle) α, i.e., the punching force F/cam plate thrust force, may be expressed as follows:

$$F/Q=1/(\tan\alpha+2^*\mu) \quad (2)$$

At this time, the cam plate 3 moves by a moving distance SL in the horizontal direction and thereby the punch 6 moves by a moving distance PL in the vertical direction.

Still more, because the punch 6 is guided by the straight guide hole 12 during punching shown in FIG. 3B described above, the punch 6 does not turn centering on its axial line V-V and punches holes only by a shearing force between it and the die hole 9 based on the punching force F described above, i.e., by way of press-cutting of punching holes by pressing the punch 6 to sheets of paper at right angles.

Figure 3C:
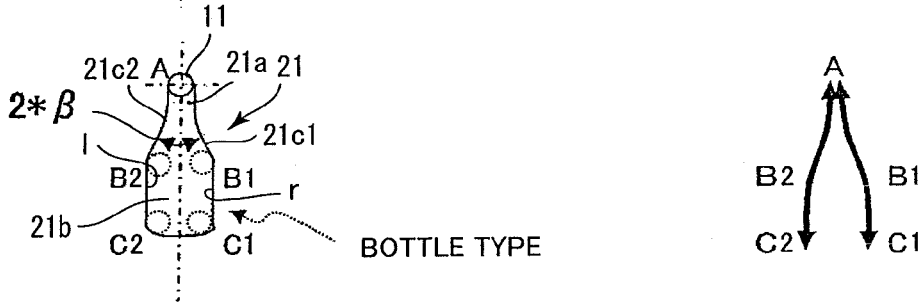

Next, a punching operation of the present invention will be explained with reference to FIG. 3C. When the cam plate 3 moves in the right direction with the predetermined thrust force Q from the state of the stand-by position A where the actuation pin 11 is located at the one-end linear portion 10*a* of the cam 10, the actuation pin 11 enters the left-downward inclined surface 10*b*1 of the V-shaped portion 10*b* of the cam 10 and also shifts so as to abut with the inclined surface 21*c*1 from the straight upper part 21*a* of the guide hole 21. Still more, as the cam plate 3 moves further in the right direction, the actuation pin 11 moves downward by being guided by the left-downward inclined surface 10*b*1 having the inclined angle α of the cam 10 and is also guided by the inclined surface 21*c*1 of the guide hole. Then, the punch 6 turns by a predetermined degree centering on its axial line V-V. As the cam plate 3 moves in the right direction further, the actuation pin 11 moves from the inclined surface 21*c*1 of the guide hole to the right straight wall of the wide lower part 21*b*. Then, the punch 6 stops to turn and the actuation pin 11 reaches the bottom part U of the V-shaped portion 10*b* of the cam. The punching position B1 of the punch 6 is the position corresponds to the inclined surfaces 10*b*1 and the inclined surface 21*c*1 of the cam and the guide hole described above and the chip discharging position C1 is the position corresponds to the bottom part U and the lower part 21*b*.

At the punching position B 1, the punch 6 acts in the minus direction, i.e., in the direction of reducing by inclined angle β of the guide hole 21, with respect to the inclined angle α of the cam 10. Thereby, the punch 6 turns centering on the axial line in the direction of slowing down with respect to the inclined surface of the cam 10 and acts so that the downward movement by the inclined surface of the cam 10 is slowed down by the inclined angle β of the guide hole. The punch 6 obtains a large punching force F by that. That is the relationship of the thrust force Q of the cam plate 3 and the punching force F of the punch 6 may be expressed as follows:

$$Q=F^*\{(\tan(\alpha-\beta)+2^*\mu)\} \quad (3)$$

And the effect of the inclined angle (punching force F/thrust force Q) may be expressed as follows:

$$F/Q=1/\{(\tan(\alpha-\beta)+2^*\mu)\} \quad (4)$$

Accordingly, the inclined angle β of the guide hole 21 supplements the inclined angle (wedge angle) α of the cam 10 and increases the punching force F of the punch by that much (by the inclined angle β).

Still more, at the punching position B1 described above, the punch 6 turns along the inclined surface 21*c*1 of the guide hole 21 and may punch through sheets of paper efficiently by adding a method of cutting by turning the blade edge 6*a* of the punch 6, i.e., a so-called pulling-cut (a method of punching by turning a pipe-like blade edge while screwing and pressing it against sheets of paper) in addition to the press-cutting by way of shearing based on the punching force F described above.

When the cam plate 3 moves further in the right direction, the actuation pin 11 moves upward from the bottom part U of the cam by being guided by the right-downward inclined surface 10*b*2 and moves also along the right wall surface r of the wide lower part 21*b* (C1→B1). Then, the actuation pin 11 shifts to the upper part 21*a* along the inclined surface 21*c*1 of the guide hole 21 while turning the punch 6 in the reverse direction and shifts to the other-end linear portion 10*c* while moving the punch 6 to the stand-by position A. While the inclined angle β of the guide hole acts in the direction of advancing the inclined angle α of the cam, i.e., in the direction of increasing the cam inclined angle, at the position B1 in this stroke, this stroke is a return stroke, so that the punch 6 may be quickly returned to the stand-by position A without applying no large force to the punch 6.

When the cam plate 3 is moved in the left direction, the actuation pin 11 moves from the other-end linear portion 10*c* to the one-end linear portion 10*a* by going through the V-shaped portion 10*b* and also moves while abutting with the left wall surface 1 of the guide hole 21. That is, the actuation pin 11 shifts from A→B2→C2 and then C2→B2→A. The punch 6 increases its punching force F and turns in the same manner as described above, so that it may punch a hole efficiently at the punching position B2. When the cam plate 3 is moved in the right direction, the actuation pin 11 always abuts with the right wall surface r of the guide hole 21 by the frictional force with the cam 10 and when the cam plate 3 moves in the left direction, the actuation pin 11 abuts with the left wall surface 1 of the guide hole 21 in the same manner, so that the punch 6 may be guided accurately with the predetermined limited movement.

Figures 4A, 4B:
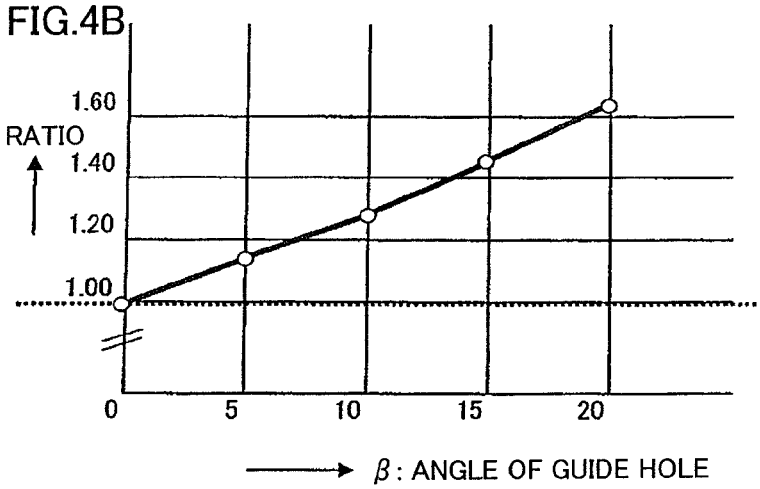

When the punching force is calculated based on the equation (4) described above by setting the frictional coefficient μ as 0.2, it turns out as shown in FIGS. 4A and 4B. When the inclined angle α of the cam 10 is 45° and if the inclined angle β of the guide hole 21 is 20° for example, it is possible to obtain a punching force F of 1.62 times of the punching unit whose guide hole is a straight long hole (β=0).

Figure 5A:
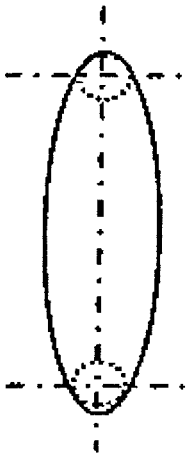
FIGS. 5A, 5B 5C show guide holes according to other embodiments, wherein FIGS. 5A, 5B and 5C respectively show the guide holes having different shapes.
Figure 5B:
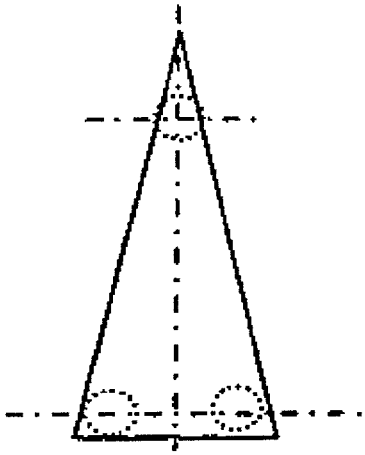
Figure 5C:
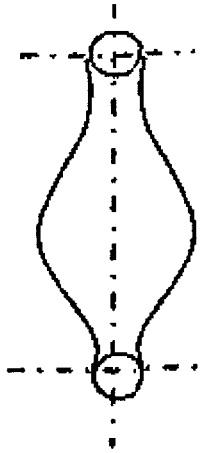

FIGS. 5A, 5B and 5C show different embodiments in which the guide holes have other shapes. FIG. 5A shows a long oval guide hole in which upper and lower end parts are located at the same position in terms of the horizontal direction and an inclined angle β gradually changes vertically so that it is zeroed at the intermediate part as the cam plate moves in one direction. FIG. 5B shows a triangular guide hole in which an inclined angle β is constant from the upper end part to the lower end part. FIG. 5C shows a guide hole formed into the shape of a lantern in which the upper and lower end parts are located at the same position in terms of the horizontal direction and an inclined angle β is maximized at positions corresponding to the punching positions B1 and B2. Then, the inclined angle is zeroed and becomes minus and returns to the original position in terms of the horizontal direction at the lower end part. The shape of the guide hole is not limited to those embodiments described above and may be any shape as long as the guide hole has an inclined surface that turns the punch in the direction of reducing the inclined angle corresponding to the inclined surface of the cam at the punch punching position.

What is claimed is:

1. A punching unit for punching holes through materials to be punched by engaging a punch with a die, comprising:

an actuation pin fixed so as to protrude from the side of said punch;

a cam member reciprocated in the direction orthogonal to the moving direction of said punch;

a cam formed of a grooved hole that is formed through said cam member, engages with said actuation pin and has a V-shaped portion, one linear portion that extends from one end of the V-shaped portion and another linear portion that extends from another end of said V-shaped portion; and a fixing member with a guide hole formed therethrough, the guide hole having a predetermined shape to guide said actuation pin relative to said guide hole;

wherein said guide hole has one end part having a width fitting with said actuation pin at positions corresponding to the linear portions of said cam and inclined surfaces extending to the both sides of the moving direction of said cam member from the one end part at positions corresponding to the V-shaped portion of said cam; and as said cam member moves, said actuation pin engages with the inclined surface of the V-shaped portion of said cam, thus moving said punch in its axial direction and at the punching position for punching a hole through the material to be punched, said actuation pin is guided by one of the inclined surfaces of said guide hole, turns said punch around its axial line and acts so as to reduce an inclined angle of the inclined surface of the cam that moves said punch in the axial direction.

2. The punching unit according to claim 1, wherein said guide hole has another end part whose width is wider than said one end part at the position corresponding to the bottom part of the V-shaped portion of said cam and is formed into a shape of a bottle by said one end part, said both inclined surfaces and said other end part.

3. The punching unit according to claim 1, wherein the fixing member is a body frame that movably supports said cam member and said punch.

4. The punching unit according to claim 2, wherein the fixing member is a body frame that movably supports said cam member and said punch.

* * * * *